US009784252B2

(12) United States Patent
Berbuer

(10) Patent No.: US 9,784,252 B2
(45) Date of Patent: Oct. 10, 2017

(54) HYDROSTATIC RADIAL PISTON MACHINE

(76) Inventor: Juergen Berbuer, Aachen (DE)

( * ) Notice: Subject to any disclaimer, the term of this patent is extended or adjusted under 35 U.S.C. 154(b) by 1340 days.

(21) Appl. No.: 13/493,188

(22) Filed: Jun. 11, 2012

(65) Prior Publication Data

US 2013/0145929 A1 Jun. 13, 2013

Related U.S. Application Data

(63) Continuation of application No. PCT/EP2010/069078, filed on Dec. 7, 2010.

(30) Foreign Application Priority Data

Dec. 11, 2009 (DE) ..... 10 2009 054 548

(51) Int. Cl.

| | |
|---|---|
| ***F04B 1/04*** | (2006.01) |
| ***F04B 1/06*** | (2006.01) |
| ***F03C 1/38*** | (2006.01) |
| ***F04B 1/107*** | (2006.01) |
| ***F01B 13/06*** | (2006.01) |

(52) U.S. Cl.

CPC ..... *F04B 1/063* (2013.01); *F01B 13/062* (2013.01); *F03C 1/0444* (2013.01); *F04B 1/0465* (2013.01); *F04B 1/1071* (2013.01); *F04B 1/1072* (2013.01)

(58) Field of Classification Search

CPC ..... F04B 1/04; F04B 1/0404; F04B 1/0426; F04B 1/043; F04B 1/0461; F04B 1/0465; F04B 1/063; F04B 1/1071; F04B 1/1072; F03C 1/0444; F01B 13/062

USPC ..... 417/491–498, 273; 91/484, 485, 491

See application file for complete search history.

(56) References Cited

U.S. PATENT DOCUMENTS

| | | | | |
|---|---|---|---|---|
| 3,122,104 A | | 2/1964 | Byers, Jr. | |
| 3,398,698 A | * | 8/1968 | Eickmann | F01B 13/066 417/273 |
| 3,561,328 A | * | 2/1971 | Eickmann | F01B 1/0689 91/497 |

(Continued)

FOREIGN PATENT DOCUMENTS

| | | |
|---|---|---|
| DE | A 1 812 635 | 6/1970 |
| DE | A 1 776 238 | 2/1974 |
| DE | A 24 52 092 | 5/1976 |

(Continued)

*Primary Examiner* — Theodore Stigell
*Assistant Examiner* — Chirag Jariwala
(74) *Attorney, Agent, or Firm* — Von Rohrscheidt Patents

(57) ABSTRACT

A hydrostatic radial piston machine includes a radial cylinder block with cylinder bores which extend from an outer circumferential surface of the radial cylinder block into an interior of the radial cylinder block; a number of pistons which corresponds to the number of cylinder bores; a cam ring, and ends of the pistons which face away from the radial cylinder piston block are supported movably on an inner circumferential surface of the radial cylinder block during a rotation of the radial cylinder block; two control plate elements which extend respectively with a face oriented towards the radial cylinder block towards a central plane of the radial cylinder block, which central plane is perpendicular to the rotation axis. Each control plate element includes a bearing portion in which radially acting forces are transferable to a respective mating surface in the housing or housing cover mounted in the housing.

14 Claims, 5 Drawing Sheets

(56) References Cited

U.S. PATENT DOCUMENTS

| | | | | | |
|---|---|---|---|---|---|
| 3,951,044 | A | * | 4/1976 | Eickmann | F01B 13/066 91/485 |
| 4,624,174 | A | * | 11/1986 | Eickmann | F01B 1/0603 91/485 |

FOREIGN PATENT DOCUMENTS

| | | |
|---|---|---|
| DE | A 41 23 674 | 1/1993 |
| DE | A 41 23 675 | 1/1993 |
| EP | 2510192 B1 | 12/2010 |

* cited by examiner

CONTINUOUSLY SPHERICALLY CAMBERED INNER ENVELOPING SURFACE OF CAM RING

HYDROSTATIC RADIAL PISTON MACHINE

RELATED APPLICATIONS

This application is a continuation of PCT/EP2010/069078 filed on Dec. 7, 2010 claiming priority from German patent application DE 10 2009 054 548.4 filed on Dec. 11, 2009.

FIELD OF THE INVENTION

The invention relates to a hydrostatic radial piston machine including: a housing; a radial cylinder block rotatably supported in the housing about a rotation axis and including a plurality of bores extending from an outer enveloping surface of the radial cylinder block into an interior of the radial cylinder block and arranged distributed over a circumference of the radial cylinder block; a plurality of pistons which corresponds to the plurality of bores which pistons are movably supported in the bores and respectively define an operating cavity for a hydraulic fluid together with an associated bore; a cam ring which is arranged eccentric relative to the radial cylinder block and which circumferentially envelops the radial cylinder block and wherein ends of the pistons oriented away from the radial cylinder block are movably supported at an inner enveloping surface of the cam ring during a rotation of the radial cylinder block; two control plate elements including a total of at least two control cross-sections, at least one control cross-section connected with the inlet channel and at least another control cross-section connected with the outlet channel, wherein both control plate elements extend respectively with a face oriented towards the radial cylinder block towards a central plane of the radial cylinder block, which central plane is perpendicular to the rotation axis, and both control plate elements extend with the faces oriented towards the radial cylinder block beyond a plane which is defined by a face of the radial cylinder block that is oriented towards the respective control plate element at a greatest axial width of the radial cylinder block; a plurality of pass through channels in the radial cylinder block corresponding to the plurality of bores in the radial cylinder block, wherein the pass through channels as a function of the rotational position of the cylinder block in the cam ring respectively connect an operating cavity with a control cross-section corresponding with the inlet channel or with a control cross-section corresponding with the outlet channel or are closable by a closing surface arranged at the control plate element, wherein each control plate element includes a bearing portion in which radially acting forces are transferrable to a respective opposite surface in the housing or to a housing cover supported in the housing.

BACKGROUND OF THE INVENTION

Radial piston machines, this means radial piston pumps and radial piston engines, among other things can be differentiated in how hydraulic fluid is provided to operating cavities in the radial cylinder block. It is known from EP-A-0 401 408 that the supply and removal of hydraulic fluid is performed through a stationary control pinion that is connected with the housing. Disadvantages of this very widely used configuration are that only rather narrow flow channels (inlet and outlet channels) can be implemented in the control pinion and that due to the flow channels axially run out of the control pinion, the mechanical bending load on the control pinion is rather high. It can be recited as an advantage of the known configuration that the bearing of an input- or output shaft is hardly loaded. However, the fit between the outer enveloping surface of the control pinion and the inner enveloping surface of the rotating radial cylinder block is rather problematic. Therein due to the configuration no zero gap is feasible, wherein the leakage increases with the third power of the clearance, which yields greater leakage rates in particular for increasing wear. Furthermore the known principle of control pinion radial cylinder block fit is sensitive to hydraulic fluids contaminated with dirt particular and sensitive to rapid temperature changes.

An alternative principle of supplying/removing hydraulic fluid to/from the radial cylinder block is known from the printed documents DE-A-1 812 635, DE-A-24 52 092, DE-A-41 23 674, and DE-A-41 23 675. In the configuration disclosed in these printed documents the control plate element which can also be integrally configured in one piece with the housing is arranged axially adjacent to the radial cylinder block. Problems of this configuration are large axial forces and the need to support these large axial forces in a permanent manner with little wear. Furthermore the radial reactive forces from the hydraulic pressure impact the shaft and have to be received by the shaft bearings.

A radial piston machine as described supra is known e.g. from U.S. Pat. No. 3,951,044. The machine disclosed therein includes two control plate bodies arranged on opposite sides of the radial cylinder block, wherein the control plate bodies have a spherical configuration on each side oriented towards the radial cylinder block which spherical shape interacts with a hollow spherical shape of the lateral surfaces of the radial cylinder block arranged opposite thereto (c.f. in particular FIG. 4 provided therein). In order to prevent binding and friction between the control plate elements and the radial cylinder block during operation of the machine at least one control plate element is radially moveable in all directions in the known machine, this means in axial and also in radial direction. Consequently the rotating shaft connected with the radial cylinder block has to receive the radial forces generated during operation due to the hydraulic pressures. This in turn leads to an increased complexity for the shaft and its support and to potential wear.

The same principle of preventing possible alignment errors in the fit between the radial cylinder block and the control plate element(s) through the option of a radial displacement of at least one control plate element is also used as a basis for the machines according to DE-17776 238 A and U.S. Pat. No. 3,122,104 A. In the double stroke machine (two piston strokes per revolution) according to U.S. Pat. No. 3,122,104 A which does not include an eccentrical cam ring but an elliptical cam ring, this does not cause any problem due to the symmetry of the mutually balancing radial forces. In the single stroke machines with eccentric lifting ring the known principle, however, leads to significant friction and significant requirements with respect to the shaft bearing. For these reasons the solutions according to the three older printed documents have not been used in practical applications.

BRIEF SUMMARY OF THE INVENTION

It is an object of the invention to provide a radial piston engine in which the hydraulic forces can be completely received in a hydrostatic manner and can be supported in a stable manner.

Based on the radial piston machine described supra the object is achieved in that each control plate element includes a bearing portion in which radially acting forces are transferable to a respective opposite surface in the housing or a housing cover support therein.

A control plate element in the sense of the invention can be a component that is separate from the housing as well as an embodiment integrally connected with the housing or with a housing cover. A control plate element thus does not have to be flowed through by the hydraulic fluid which can be the case when both control cross sections, this means for supplying and also removing hydraulic fluid from the cylinder cavities, are arranged in a single control plate element, whereas the other control plate element does not perform any function with respect to the fluid supply of the radial cylinder block. The term control plate element in the present meaning has to be interpreted from a geometric and also mechanical point of view and not necessarily with respect to a flow through with hydraulic fluid. It is significant that the control plate element is axially adjacent to radial cylinder block.

According to the invention viewed in axial direction not only an engagement of the two control plate elements in the radial cylinder block is provided but also a reaction of the radial forces through the control plate elements. Thus, in an axial sectional view the two components overlap, wherein the control plate elements in a portion that is radially further inside protrude in a direction towards the axial center of the cylinder star, wherein a radially outer portion of the cylinder star quasi overlaps the two control plate elements. Based on the support according to the invention for the control plate elements a complete hydrostatic unloading of the hydraulic forces occurring during operations and a stable reaction of the hydraulic forces is provided through the housing or the housing cover. Due to the symmetrical configuration of the two control plate elements with respect to a center plane of the radial cylinder block the hydraulic forces acting in radial direction in the portions of the opposing control plate elements in which the control plate elements extend into the radial cylinder block can be initially reacted through opposite forces extending at a slant angle relative to the rotation axis. Thus, each control plate element extending into the cylinder star figuratively speaking and in an axial sectional view performs the function of an "console", whereas respectively in the portion of the cylinder star in which the width in a radially outward view functions at least as a type of "capstone" which transposes radial compression forces into a pair of opposite forces, whose radial component is respectively reacted by the opposite control plate elements into housings or housing covers supporting the control plate elements.

Contrary thereto the control plate elements for a radially extending separation plane in the portion of the control cross section, this means in the control of the interface between control plate element and cylinder star are configured disc shaped and have faces exclusively extending perpendicular to the rotation axis. Based on this configuration, reacting the radial forces occurring during operations through the control plate elements is impossible. The same applies for spherical and/or conical control plate elements which, however, cannot transfer any radial forces into the housing or its cover since there is no respective support. Here the invention provides a solution through an engagement of the radial cylinder block and the control plate elements and their support in the housing or housing cover which leads to a particularly high pressure load bearing capability of the radial piston engine according to the invention. Another advantage of the invention is the great robustness of the machine against pressure surges and vibrations since a closed force flow is provided integrating the typically very stiff machine housing which in turn causes very low sound emissions. Due to the complete hydrostatic unloading of the hydrostatic forces the machine according to the invention is also suitable for media with inferior lubrication properties this means also for applications in so called water hydraulics.

Preferably the radial cylinder block includes at least one support portion in which the axial width is less than in a clearance portion radially adjacent in outward direction with respect to the support portion, wherein preferably at least one control cross section of the control plate element is arranged in the support portion. Further preferably at least one control plate element includes a support portion corresponding to the support portion of the radial cylinder block and a bearing portion radially adjacent in outward direction to the support portion or oriented away in axial direction from the support portion. In the bearing portion the respective control plate element is received in a housing or a housing cover so that the forces introduced by the radial cylinder block into the control plate element can be reacted further into the housing or the housing cover.

A configuration for the radial cylinder machine according to the invention that is mechanically particularly robust is obtained when the support portion preferably extending from a central torque coupling portion (e.g. provided in the form of a multi tooth bore or a shaft pinion) extends in radial direction up to a diameter which is approximately 60%-90%, preferably to 70%-80% of the maximum diameter of the radial cylinder block.

A particularly advantageous geometry for the control plate element is provided when the control plate element has a conical shape, a conical annular shape or a convex shape, in particular a spherically cambered shape, wherein preferably the support portion is configured conical, with a conical annular shape or a convex, in particular a spherically cambered shape. The bearing portion that is adjacent in axial direction and which can have a larger diameter than the support portion then preferably has a cylindrical shape which provides a particularly simple support in the housing or in the housing cover.

For a conical control plate element or a control plate element with a conical annular shape the cone angle should be between 90° and 150°, preferably between 110° and 130° and particularly preferably 120°, since this yields a force triangle with identical angles and with an angle of 120° respectively between the radially acting pressure force and the support forces oriented at a slant angle. The optimum cone angle for a particular case can be derived from the respective diameters at the beginning at the end of the cone section and the number of operating cavities distributed over the circumference of the radial cylinder block and can be determined according to the known rules of the hydraulics under the premise of a complete hydraulic force balancing in an arithmetic exact manner.

Further configuring the invention it is proposed that the radial cylinder block and at least one control plate element engage one another in axial direction as male and female parts.

When a respective control plate element is arranged on both sides of the radial cylinder block at least one of them should be preloaded through a washer spring element supported at a housing or at a housing cover, preferably an undular washer in a direction towards the opposite control plate element. Thus, an axial gap compensation, this means tightness, is facilitated in the portion of the separation plane between the control plate element and the cylinder star in particular in the portion of the control cross sections.

Irrespective whether the inlet our outlet of hydraulic fluid to the cylinder block or from the cylinder block is only provided through one or two control plate elements it is helpful from a manufacturing point of view that control channels of two opposite control plate elements and a pass through channel of the radial cylinder block arranged there between are aligned with one another, preferably form a continuous cylindrical bore with constant cross section. In order to have as many identical components as possible the control channels in a control plate element that is not being used for hydraulic fluid inlet or outlet are not being used which is in no way detrimental.

Also when it is feasible in principle to provide the pistons at the piston heads with a separate seal element e.g. a piston ring it is a preferred configuration that one respective piston head of the pistons is configured as a beaker in longitudinal direction and contacts with one beaker edge in a sealing manner at an inner enveloping surface of the respective bore of the radial cylinder block without a separate seal element being connected there between, wherein the pistons are preferably made from plastic material and further preferably are plastic injection molded components. The beaker edge thus has a depth in axial direction of the piston and a thickness in axial direction of the piston which provide that the fluid pressure in the operating cavity using the component elasticity provides a sufficient surface pressure between the beaker edge outer jacket and the bore jacket surface. When producing pistons of this type as plastic injection molded components from a material with sufficient strength, low friction relative to the material of the radial cylinder block and simultaneously good elasticity, the pistons according to the invention can be produced in a very cost effective manner.

BRIEF DESCRIPTION OF THE DRAWINGS

The invention is subsequently described in more detail based on two embodiments of a radial piston machine with reference to drawing figures wherein.

DETAILED DESCRIPTION OF THE INVENTION

Figure 1:
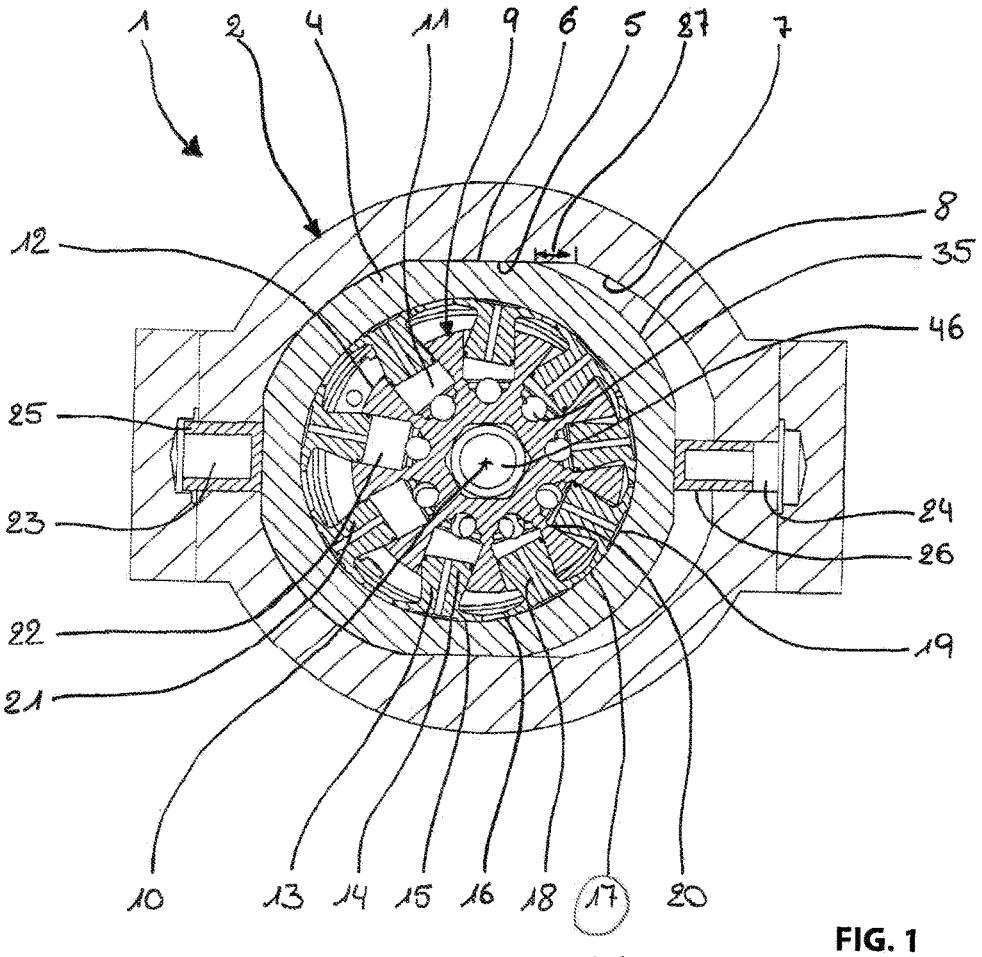
FIG. 1 illustrates a cross section of a first embodiment of a radial piston machine with pistons and piston rings.
Figure 2:
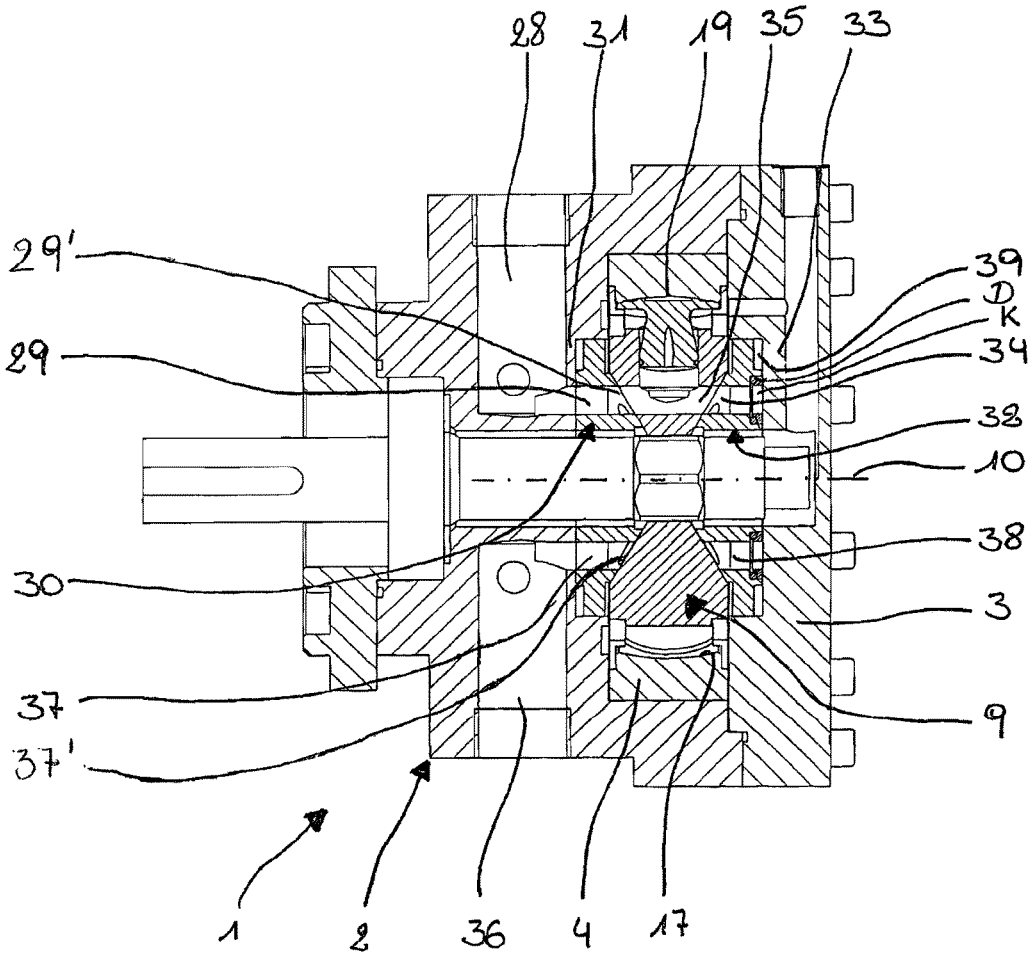
FIG. 2 illustrates a cross sectional view like FIG. 1, however cut in longitudinal direction.
Figure 2A:
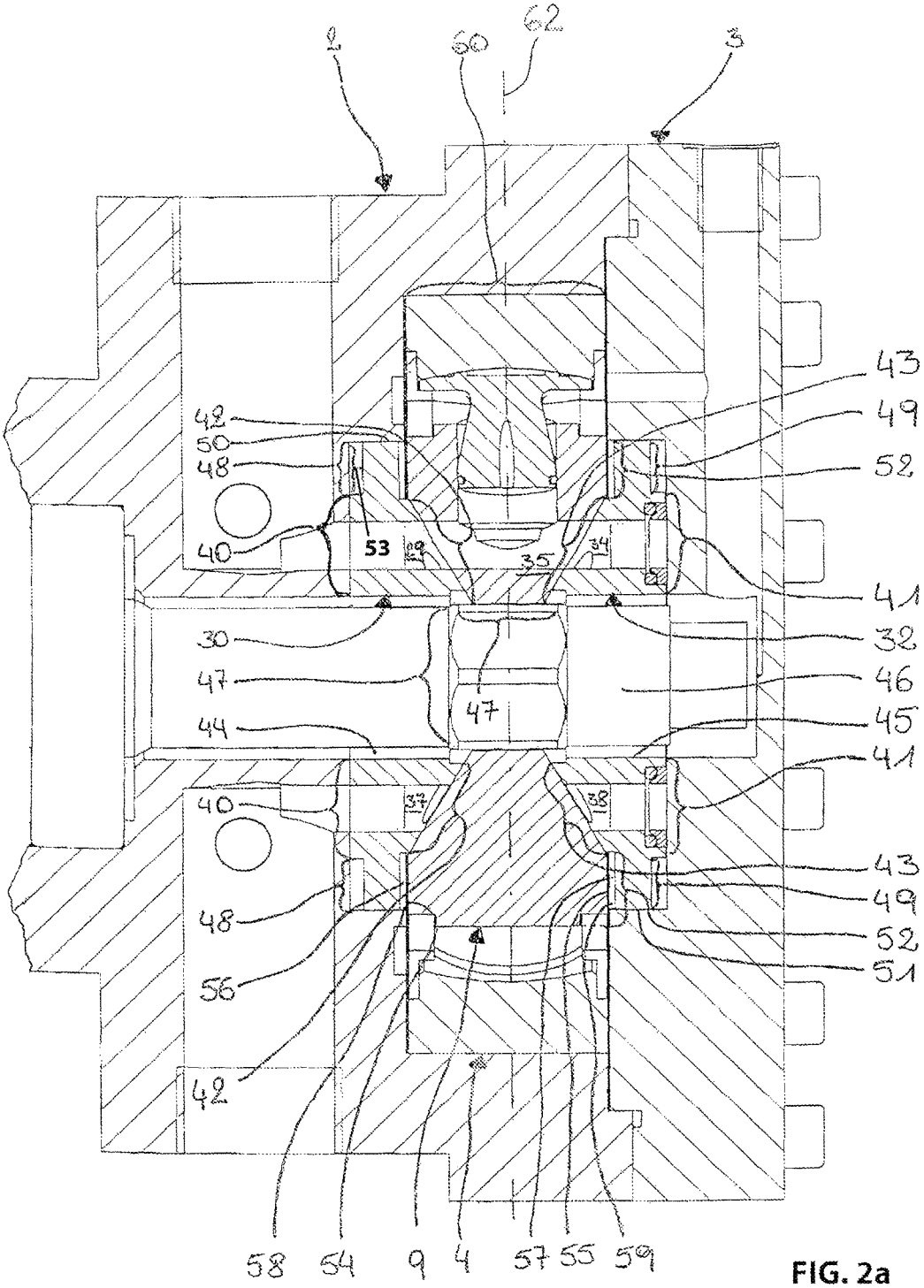
FIG. 2*a* illustrates an enlarged view of the redial cylinder block and the control plate elements according to FIG. 2.

A radial piston machine 1 illustrated in FIGS. 1, 2 and 2*a* includes a housing 2 which is closed fluid tight viewed in axial direction on one side with a housing cover 3. A cam ring 4 is moveably arranged in the housing 2, thus moveable along two respective surfaces 5, 6 which are configured on one side on an inner enveloping surface 7 of the housing 2 and on the other side at an outer enveloping surface 8 of the cam ring.

The radial piston machine 1 furthermore includes a rotor configured as a radial cylinder block 9 which is rotatable about a rotation axis 10. In the present case the cylinder block 9 includes nine bores 11 evenly distributed over a circumference of the radial cylinder block 9 and starting from an outer enveloping surface 12 of the radial cylinder block 9 and extending in radial direction into an interior of the radial cylinder block 9, this means towards the rotation axis 10.

A piston 13 is moveably arranged in each bore 11, wherein each piston 13 includes a piston head 14 through which it is supported in a sealed manner in the bore 11 and a plate shaped piston base 15 through whose lower face 16 the respective piston 13 is supported at a spherically cambered inner enveloping surface 17 of the cam ring 4. Each piston 13 includes a pass through bore 18 extending from the piston head 14 to the piston base 15, wherein the pass through bore leads at the face 16 of the piston base 15 into a pressure cavity 19 which in turn causes a hydrostatic unloading of the support of the piston base 15 at the cam ring 4. In a known manner each piston has a circumferential groove in the portion of its piston head 14 wherein a, piston ring 20 is inserted into the groove for purposes. Between the piston head 14 and the piston base 15 there is a piston neck which is reduced in diameter, wherein the piston neck depending on the position of the piston 13 in the bore 11 facilitates tilting the longitudinal piston axis relative to the bore longitudinal axis.

According to the known basic principle of radial piston machines the rotation axis 10 of the radial cylinder block 9 and the center axis of the cam ring 4 (the center axis of the cam ring is not illustrated in the drawing figure for reasons of clarity) are arranged eccentrial with respect to one another, wherein the variable amount of eccentricity defines the stroke of the pistons 13. During a complete revolution of the radial cylinder block 9 about the rotation axis 10 the pistons 13 therefore move from an upper dead center where they have moved the deepest into the bore 11 to a lower dead center where they define a maximum size operating cavity 22 together with the walls of the bore 11. The amount of the eccentricity between the radial cylinder block 9 and the cam ring 4 can be varied in the present embodiment through two hydraulic actuation cylinders whose cylinder bores 23 and 24 are arranged at opposite sides of the housing 2 and which are respectively provided with a beaker shaped piston 25, 26 that is axially moveable in the cylinder bore 23, 24. Based on the position illustrated in FIG. 1 in which the eccentricity is at a maximum the cam ring 4 can be moved to the right by a path 27 parallel to the planar surfaces 5 and 6 which reduces the eccentricity and also the feed rate of the radial piston machine to 0.

In a manner that is also known in the art, hydraulic fluid is fed through a radial piston machine, which is described based on the function of a radial piston pump, in a manner where hydraulic fluid flows from an inlet channel 28 arranged in the housing 2 and angled by 90° at its radial inner end into a control channel 29 of a control plate element 30. The control plate element 30 is arranged between a housing wall 31 and the radial cylinder block 9. Another substantially identically configured control plate element 32 is arranged on the opposite side of the radial cylinder block 9 and is defined by a housing wall 33 on its side oriented away from the cylinder block 9. In both control plate elements 30, 32 the respective control channel 29, 34 is expanded in a circular segment shape in a face of the control plate element 30, 32 oriented towards the radial cylinder block 9. This known configuration facilitates that hydraulic fluid flows from the control channel 29 through a pass-through channel 35 respectively associated with each bore 11 in the radial cylinder block 9 into the respective operating cavity 22 during a suction phase extending over an angular range of approximately 150°. As soon as a piston 13 has reached its upper dead center, the flow connection between the control channel 29 associated with the inlet channel 28 and the associated pass-through channel 35 ends, whereas in the next moment a connection between the additional control channel 37 configured like the control channel 29 and associated with the outlet channel 36 is established on the "pressure side" of the control plate element 30 or the radial piston machine 1. The cross-sections of the control channels 29, 37 which are arranged in the respective separation planes between the control plate element 30 and the radial cylinder block 9 are designated as control cross-sections 29', 37'.

Due to an ongoing rotation of the radial cylinder block 9, each piston 13 pushes the hydraulic fluid arranged in the associated operating cavity 22 through the pass-through channel 35 associated with each bore 11 and the control channel 37 that is also expanded in a groove shape and extends over a circular segment of approximately 150° into the outlet channel 36. Between the control cross-sections 29', 37' of the control plate element 30, there are two closure surfaces offset by 180° from one another (not illustrated in the figures) which close the pass-through channels 35 respectively into two intermediary portions between the control cross-sections 29' and 37' in order to prevent a shorting between the suction side and the pressure side. The control plate element 32 illustrated in FIG. 2 on the right also includes a second, this means lower control channel 38 which in the present case like the upper control channel 34 of this control plate element 32 is not functional.

In order to be able to feed also large volume flows on the suction side of the radial piston machine 1 without cavitation, the suction side control channel 34 of the control plate element 32 can also be connected with the inlet channel 28 as required. On the pressure side, the connection of the control channel 38 with the outlet channel 36 is hardly required. In order to have identical components, however, both control plate elements 30, 32 are respectively provided with two control channels 29, 37 and 34, 38.

In order to facilitate an axial gap compensation in the portion of the control plate elements 30, 32 and of the radial cylinder block 9, there is a spring element 39, which is only schematically illustrated and configured as an undulated washer, between the housing wall 33 and the face of the control plate element 32 oriented towards the housing wall. The spring element 39, however, is not configured to apply forces that are large enough to compensate the high axially acting hydraulic forces. Thus, a pressure loaded compensation surface K is additionally provided at the face of the cover 3 oriented towards the control plate element 32. The compensation surface K is configured double kidney-shaped and corresponds on the one hand side with the suction side control channel 29 and on the other hand side with the pressure side control channel 37. Through a seal element D which is also configured kidney-shaped, a volume that corresponds to the compensation surface K is sealed between the housing cover 3 and the rear face of the control plate element 32 oriented towards the housing cover 3. This way a pressure proportional axial contact force is generated which is always only a few percent above the axial component of the hydraulic gap force at the respective control plate element 30, 32. Thus the gap compensation is provided without providing excessive forces which would only generate increased friction.

Based on the enlarged illustration according to FIG. 2*a*, now particular features of the control plate element 30, 32 and the radial cylinder block 9 are illustrated.

Both control plate elements 30, 32 respectively include a conical ring shaped support portion 40, 41 which interacts with a complementary also conical ring shaped support portion 42, 43 at the opposite faces of the radial cylinder block 9. While the control channels 29, 37 and 34, 38, this means in particular also the control cross-sections 29', 37', are arranged in the support portions 40, 41 of the control plate elements 30, 32, the pass through channels 35 configured as pass through bores are configured in the support portions 42 and 43 on both sides in the radial cylinder block 9.

Both control plate elements 30, 32 respectively include a central pass-through bore 44, 45 through which a drive shaft 46 of the radial piston machine 1 extends. A torque coupling portion 47 of the radial cylinder block 9 is configured as an internal hexagon into which a respectively adapted external hexagon of the drive shaft 46 is inserted torque proof.

Both control plate elements 30, 32 include a cylindrical support portion 48, 49 adjacent to the respective support portion 40, 41, wherein the outer enveloping surface 50, 51 is respectively supported in an adapted recess in the housing 2 or the housing cover 3. The radial cylinder block 9 includes a freewheeling portion 52, 53 adjacent in radial direction at the support portions 42 and 43 in which a respective gap 58, 59 is arranged between the respective face 54, 55 of the radial cylinder block 9 and an opposite face 56, 57 of the control plate elements 30, 32.

It can be derived from FIG. 2*a* that an axially measured width of the radial cylinder block 9 decreases in the support portion 42, 43 towards the rotation axis 10. The greatest axial width 60 is provided in the freewheeling portions 52, 53, whereas the smallest axial width 61 is provided in the torque coupling portion 47. The cone angle of the control plate elements 30, 32 is respectively 120°, so that the trace lines of the drawing sectional plane with the control plate elements 30, 32 respectively enclose an angle of 60° with the rotation axis 10.

It is furthermore visible that the control plate elements 30, 32 with their conical ring shaped faces forming the support portions 42, 43 extend over the planes formed by the faces 54, 55 of the radial cylinder block 9 in a direction towards a center plane 62 of the radial cylinder block 9, which center plane is perpendicular to the rotation axis 10.

Figure 3:
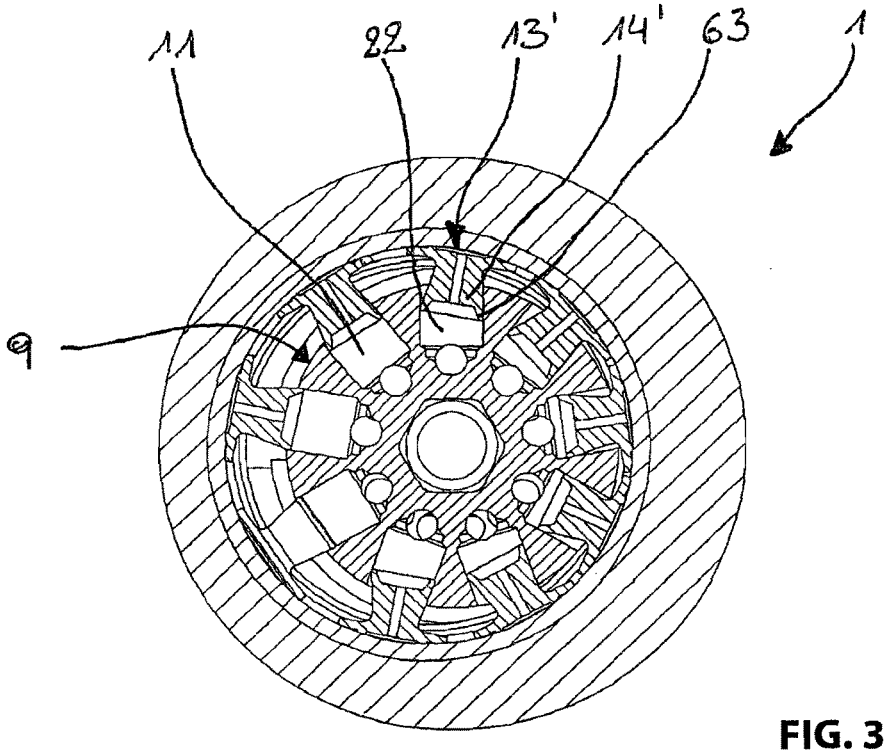
FIG. 3 illustrates a cross sectional view of a second embodiment of a radial piston machine with pistons shaped as beakers.
Figure 4:
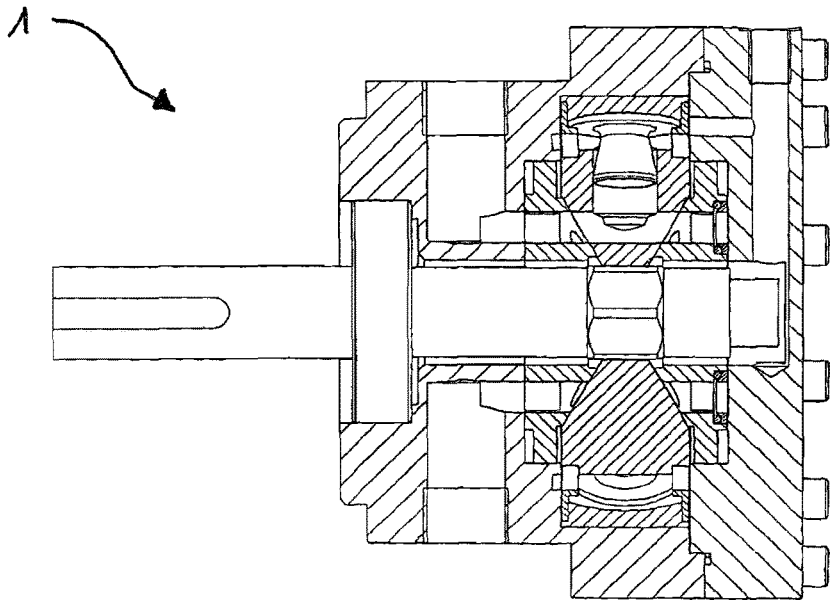
FIG. 4 illustrates a view analogous to FIG. 3, however in longitudinal sectional view.

The difference of the radial piston machine 1 illustrated in FIGS. 3 and 4 is that the pistons 13' therein have a beaker shape in longitudinal direction. A beaker edge 63 arranged in the respective piston head 14' has a small wall thickness that is reduced towards the free end of the beaker edge 63, so that as a consequence of a pressure buildup in the operating cavity 22 of the respective bore 11 in the radial cylinder block 9, a self reinforcing sealing effect is provided. The pistons 13' are configured as injection molded plastic components and are made e.g. from PEEK (poly ether ether ketone) or PAI (poly amide imide).

The pistons 13' are rotation symmetrical components, wherein the plastic material used facilitates an elastic form change in its contact area with the inner enveloping surface of the bore 11, when due to its slanted arrangement of the pistons 13', the contact line in the portion of the piston head 14' defines an ellipsis during a rotation of the radial cylinder block.

Figure 5:
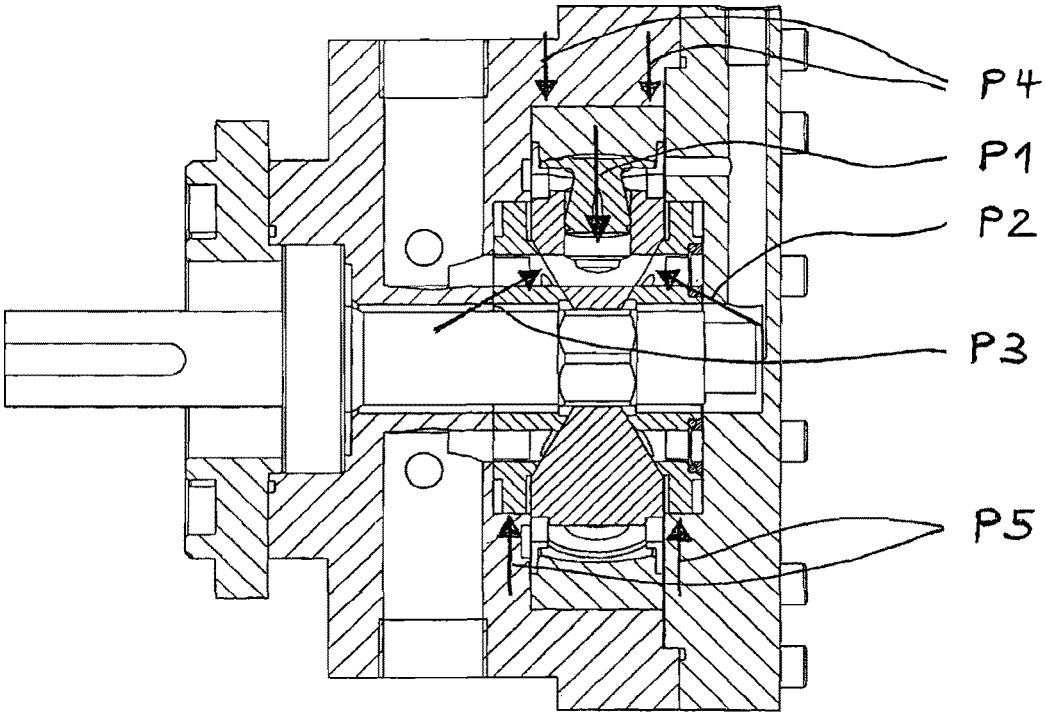
FIG. 5 illustrates a view analogous to FIG. 1, however with force vectors symbolized by arrows.

In the cross-sectional illustration according to FIG. 5, eventually the different force vectors provided during operation of the radial piston machine 1 are illustrated. The radial hydraulic forces acting in the respective operating cavity 22 illustrated by the arrow P1 are hydraulically compensated according to the invention through the symmetrically slanted faces of the radial cylinder block 9 or the control plate elements 30, 32 which is illustrated by the hydraulic force vectors according to the arrows P2 and P3. Additionally the mechanical forces according to the arrows P4 are illustrated in FIG. 5, wherein the mechanical forces are reaction forces occurring in the housing 2 to balance the hydraulic forces which are transmitted from the operating cavity 22 through the pistons 26 and the cam ring 4. The forces acting in radial direction upon the control plate elements 30, 32 are transferred in their support portions 48, 49 to a respective opposite surface in the housing 2 or the housing cover 3, where reaction forces are illustrated in the form of the arrows P5.

REFERENCE NUMERALS AND DESIGNATIONS

1 radial piston machine
2 housing
3 housing cover
4 cam ring
5 planar surface
6 planar surface
7 inner enveloping surface
8 outer enveloping surface
9 radial cylinder block
10 rotation axis
11 bore
12 outer enveloping surface
13, 13' piston
14, 14' piston head
15 piston base
16 face
17 inner enveloping surface
18 pass through bore
19 pressure cavity
20 piston ring
21 piston neck
22 operating cavity
23 cylinder bore
24 cylinder bore
25 piston
26 piston
27 path
28 inlet channel
29 control channel
29' control cross-section
30 control plate element
31 housing wall
32 control plate element
33 housing wall
34 control channel
35 pass through channel
36 outlet channel
37 control channel
37' control cross-section
38 control channel
39 spring element
40 support portion
41 support portion
42 support portion
43 support portion
44 pass through bore
45 pass through bore
46 drive shaft
47 torque coupling portion
48 bearing portion
49 bearing portion
50 outer enveloping surface
51 outer enveloping surface
52 freewheeling portion
53 freewheeling portion
54 face
55 face
56 face
57 face
58 gap
59 gap
60 width
61 width
62 center plane
63 beaker edge
D seal element
K compensation surface
P1 arrow
P2 arrow
P3 arrow
P4 arrow
P5 arrow

What is claimed is:

1. A hydrostatic radial piston machine, comprising:

a housing;

a radial cylinder block rotatably supported in the housing about a rotation axis and including a plurality of bores extending from an outer enveloping surface of the radial cylinder block into an interior of the radial cylinder block and arranged distributed over a circumference of the radial cylinder block;

a plurality of pistons which corresponds to the plurality of bores, wherein the pistons are movably supported in the bores and respectively define an operating cavity for a hydraulic fluid together with the associated bore;

a cam ring which is arranged eccentric relative to the radial cylinder block and which circumferentially envelops the radial cylinder block and wherein ends of the pistons oriented away from the radial cylinder block are movably supported at a continuously cambered inner enveloping surface of the cam ring during a rotation of the radial cylinder block;

two control plate elements including a total of at least two control cross-sections, at least one control cross-section connected with an inlet channel and at least another control cross-section connected with an outlet channel, wherein the two control plate elements extend respectively with a face oriented towards a central plane of the radial cylinder block, wherein the central plane is perpendicular to the rotation axis, and the two control plate elements extend with the faces oriented towards the radial cylinder block beyond a plane which is defined by a face of the radial cylinder block, wherein the face of the radial cylinder block is oriented towards the respective control plate element at a greatest axial width of the radial cylinder block;

a plurality of pass through channels in the radial cylinder block corresponding to the plurality of bores in the radial cylinder block, wherein the pass through channels as a function of a rotational position of the cylinder block in the cam ring respectively connect the operating cavity with the control cross-section corresponding with the inlet channel or with the control cross-section corresponding with the outlet channel or are closable by a closing surface arranged at the control plate element, wherein each control plate element includes a radial bearing portion in which radial forces from the radial cylinder block are transferrable to a respective opposite radial surface in the housing or to a radial surface of a housing cover supported in the housing through a direct contact of the radial bearing portion with the radial surface.

2. The radial piston machine according to claim 1, wherein the at least one control plate element penetrates the radial cylinder block in an axial direction so that the radial cylinder block and the at least one control plate element engage one another.

3. The radial piston machine according to claim 1, wherein the pass through channels of the radial cylinder block which interact respectively with the operating cavity extend respectively from a support portion to an opposite support portion of the cylinder block.

4. The radial piston machine according to claim 1, wherein the control plate element has a conical, cone ring shaped or convex spherically cambered shape, wherein a support portion of the control plate element is configured conical, conical ring shaped or convex-spherically cambered shaped.

5. The radial piston machine according to claim 1, wherein control channels of the two opposite control plate elements and one of the pass through channels of the radial cylinder block arranged there between are aligned with one another, forming a continuous cylindrical bore with a constant cross-section.

6. The radial piston machine according to claim 1, wherein the continuously cambered inner enveloping surface of the cam ring is continuously spherically cambered.

7. A hydrostatic radial piston machine, comprising:

a housing;

a radial cylinder block rotatably supported in the housing about a rotation axis and including a plurality of bores extending from an outer enveloping surface of the radial cylinder block into an interior of the radial cylinder block and arranged distributed over a circumference of the radial cylinder block;

a plurality of pistons which corresponds to the plurality of bores, wherein the pistons are movably supported in the bores and respectively define an operating cavity for a hydraulic fluid together with the associated bore;

a cam ring which is arranged eccentric relative to the radial cylinder block and which circumferentially envelops the radial cylinder block and wherein ends of the pistons oriented away from the radial cylinder block are movably supported at an inner enveloping surface of the cam ring during a rotation of the radial cylinder block;

two control plate elements including a total of at least two control cross-sections, at least one control cross-section connected with an inlet channel and at least another control cross-section connected with an outlet channel, wherein the two control plate elements extend respectively with a face oriented towards a central plane of the radial cylinder block, wherein the central plane is perpendicular to the rotation axis, and both control plate elements extend with the faces oriented towards the radial cylinder block beyond a plane which is defined by a face of the radial cylinder block, wherein the face of the radial cylinder block is oriented towards the respective control plate element at a greatest axial width of the radial cylinder block;

a plurality of pass through channels in the radial cylinder block corresponding to the plurality of bores in the radial cylinder block, wherein the pass through channels as a function of a rotational position of the cylinder block in the cam ring respectively connect the operating cavity with the control cross-section corresponding with the inlet channel or with the control cross-section corresponding with the outlet channel or are closable by a closing surface arranged at the control plate element, wherein each control plate element includes a radial bearing portion in which radial forces from the radial cylinder block are transferrable to a respective opposite radial surface in the housing or to a radial surface of a housing cover supported in the housing through a direct contact of the radial bearing portion with the radial surface, wherein the radial cylinder block includes at least one support portion in which an axial width is smaller than in a freewheeling portion adjacent to the at least one support portion of the radial cylinder block in radially outward direction, wherein the at least one control cross-section of the control plate element is arranged in the at least one support portion of the radial cylinder block, wherein the at least one control plate element includes a control plate element support portion corresponding with the at least one support portion of the radial cylinder block, wherein the respective radial bearing portion either adjoins the control plate element support portion in a radially outward direction or is oriented away from the control plate element support portion in an axial direction.

8. The radial piston machine according to claim 7, wherein the at least one support portion of the radial cylinder block extends from a central torque coupling portion in radial direction to a diameter which has a size of 60% to 90% of a maximum diameter of the radial cylinder block.

9. The radial piston machine according to claim 7, wherein the at least one support portion of the radial cylinder block extends from a central torque coupling portion in radial direction to a diameter which has a size of 70% to 80% of a maximum diameter of the radial cylinder block.

10. A hydrostatic radial piston machine, comprising:

a housing;

a radial cylinder block rotatably supported in the housing about a rotation axis and including a plurality of bores extending from an outer enveloping surface of the radial cylinder block into an interior of the radial cylinder block and arranged distributed over a circumference of the radial cylinder block;

a plurality of pistons which corresponds to the plurality of bores, wherein the pistons are movably supported in the bores and respectively define an operating cavity for a hydraulic fluid together with the associated bore;

a cam ring which is arranged eccentric relative to the radial cylinder block and which circumferentially envelops the radial cylinder block and wherein ends of the pistons oriented away from the radial cylinder block are movably supported at an inner enveloping surface of the cam ring during a rotation of the radial cylinder block;

two control plate elements including a total of at least two control cross-sections, at least one control cross-section connected with an inlet channel and at least another control cross-section connected with an outlet channel, wherein the two control plate elements extend respectively with a face oriented towards a central plane of the radial cylinder block, wherein the central plane is perpendicular to the rotation axis, and the two control plate elements extend with the faces oriented towards the radial cylinder block beyond a plane which is defined by a face of the radial cylinder block, wherein the face of the radial cylinder block is oriented towards the respective control plate element at a greatest axial width of the radial cylinder block;

a plurality of pass through channels in the radial cylinder block corresponding to the plurality of bores in the radial cylinder block, wherein the pass through channels as a function of a rotational position of the cylinder block in the cam ring respectively connect the operating cavity with the control cross-section corresponding with the inlet channel or with the control cross-section corresponding with the outlet channel or are closable by a closing, surface arranged at the control plate element, wherein each control plate element includes a radial bearing portion in which radial forces from the radial cylinder block are transferrable to a respective opposite radial surface in the housing or to a radial surface of a housing cover supported in the housing through a direct contact of the radial bearing portion with the radial surface, wherein the control plate element has a conical, cone ring shaped or convex spherically cambered shape, wherein a support portion of the control plate element is configured conical, conical ring shaped or convex-spherically cambered shaped, and wherein a cone angle of the control plate element is between 90° and 150°.

11. A hydrostatic radial piston machine, comprising:

a housing;

a radial cylinder block rotatably supported in the housing about a rotation axis and including a plurality of bores extending from an outer enveloping surface of the radial cylinder block into an interior of the radial cylinder block and arranged distributed over a circumference of the radial cylinder block;

a plurality of pistons which corresponds to the plurality of bores, wherein the pistons are movably supported in the bores and respectively define an operating cavity for a hydraulic fluid together with the associated bore;

a cam ring which is arranged eccentric relative to the radial cylinder block and which circumferentially envelops the radial cylinder block and wherein ends of the pistons oriented away from the radial cylinder block are movably supported at an inner enveloping surface of the cam ring during a rotation of the radial cylinder block;

two control plate elements including a total of at least two control cross-sections, at least one control cross-section connected with an inlet channel and at least another control cross-section connected with an outlet channel, wherein the two control plate elements extend respectively with a face oriented towards a central plane of the radial cylinder block, wherein the central plane is perpendicular to the rotation axis, and both control plate elements extend with the faces oriented towards the radial cylinder block beyond a plane which is defined by a face of the radial cylinder block, wherein the face of the radial cylinder block is oriented towards the respective control plate element at a greatest axial width of the radial cylinder block;

a plurality of pass through channels in the radial cylinder block corresponding to the plurality of bores in the radial cylinder block, wherein the pass through channels as a function of a rotational position of the cylinder block in the cam ring respectively connect the operating cavity with the control cross-section corresponding with the inlet channel or with the control cross-section corresponding with the outlet channel or are closable by a closing surface arranged at the control plate element, wherein each control plate element includes a bearing portion in which radial forces from the radial cylinder block are transferrable to a respective opposite surface in the housing or to a housing cover supported in the housing, wherein both control plate elements are movable in axial direction relative to one another, wherein one of the control plate elements is movable in an axial direction relative to the housing or the housing cover, and wherein the other control plate element is fixated in the axial direction in the housing or the housing cover.

12. A hydrostatic radial piston machine comprising:

a housing;

a radial cylinder block rotatably supported in the housing about a rotation axis and including a plurality of bores extending from an outer enveloping surface of the radial cylinder block into an interior of the radial cylinder block and arranged distributed over a circumference of the radial cylinder block;

a plurality of pistons which corresponds to the plurality of bores, wherein the pistons are movably supported in the bores and respectively define an operating cavity for a hydraulic fluid together with the associated bore;

a cam ring which is arranged eccentric relative to the radial cylinder block and which circumferentially envelops the radial cylinder block and wherein ends of the pistons oriented away from the radial cylinder block are movably supported at an inner enveloping surface of the cam ring during a rotation of the radial cylinder block;

two control plate elements including a total of at least two control cross-sections, at least one control cross-section connected with an inlet channel and at least another control cross-section connected with an outlet channel, wherein the two control plate elements extend respectively with a face oriented towards a central plane of the radial cylinder block, wherein the central plane is perpendicular to the rotation axis, and the two control plate elements extend with the faces oriented towards the radial cylinder block beyond a plane which is defined by a face of the radial cylinder block, wherein the face of the radial cylinder block is oriented towards the respective control plate element at a greatest axial width of the radial cylinder block;

a plurality of pass through channels in the radial cylinder block corresponding to the plurality of bores in the radial cylinder block, wherein the pass through channels as a function of a rotational position of the cylinder block in the cam ring respectively connect the operating cavity with the control cross-section corresponding with the inlet channel or with the control cross-section corresponding with the outlet channel or are closable by a closing surface arranged at the control plate element, wherein each control plate element includes a radial bearing portion in which radial forces from the radial cylinder block are transferrable to a respective opposite radial surface in the housing or to a radial surface of a housing cover supported in the housing through a direct contact of the radial bearing portion with the radial surface, wherein one control plate element of the two control plate elements is arranged respectively on both sides of the radial cylinder block, and wherein a first control plate element of the two control plate elements is preloaded through a spring element supported at the housing or at the housing cover in a direction towards a second opposite control plate element of the two control plate elements.

13. A hydrostatic radial piston machine, comprising:

a housing;

a radial cylinder block rotatably supported in the housing about a rotation axis and including a plurality of bores extending from an outer enveloping surface of the radial cylinder block into an interior of the radial cylinder block and arranged distributed over a circumference of the radial cylinder block;

a plurality of pistons which corresponds to the plurality of bores, wherein the pistons are movalaly supported in the bores and ressectively define an operating cavity for a hydraulic fluid together with the associated bore;

a cam ring which is arranged eccentric relative to the radial cylinder block and which circumferentially envelops the radial cylinder block and wherein ends of the pistons oriented away from the radial cylinder block are movably supported at an inner enveloping surface of the cam ring during a rotation of the radial cylinder block;

two control plate elements including a total of at least two control cross-sections, at least one control cross-section connected with an inlet channel and at least another control cross-section connected with an outlet channel, wherein the two control plate elements extend respectively with a face oriented towards a central plane of the radial cylinder block, wherein the central plane is perpendicular to the rotation axis, and the two control plate elements extend with the faces oriented towards the radial cylinder block beyond a plane which is defined by a face of the radial cylinder block, wherein the face of the radial cylinder block is oriented, towards the respective control plate element at a greatest axial width of the radial cylinder block;

a plurality of pass through channels in the radial cylinder block corresponding to the plurality of bores in the radial cylinder block, wherein the pass through channels as a function of a rotational position of the cylinder block in the cam ring respectively connect the operating cavity with the control cross-section corresponding with the inlet channel or with the control cross-section corresponding with the outlet channel or are closable by a closing surface arranged at the control plate element.

wherein each control plate element includes a radial bearing portion in which radial forces from the radial cylinder block are transferrable to a respective opposite radial surface in the housing or to a radial surface of a housing cover supported in the housing through a direct contact of the radial bearing portion with the radial surface, wherein the control plate element has a conical, cone ring shaped or convex spherically cambered shape, wherein a support portion of the control plate element is configured conical, conical ring shaped or convex-spherically cambered shaped, and wherein a cone angle of the control plate element is between 110° and 130°.

14. A hydrostatic radial piston machine, comprising:

a housing;

a radial cylinder block rotatably supported in the housing about a rotation axis and including a plurality of bores extending from an outer enveloping surface of the radial cylinder block into an interior of the radial cylinder block and arranged distributed over a circumference of the radial cylinder block;

a plurality of pistons which corresponds to the plurality of bores, wherein the pistons are movably supported in the bores and respectively define an operating cavity for a hydraulic fluid together with the associated bore;

a cam ring which is arranged eccentric relative to the radial cylinder block and which circumferentially envelops the radial cylinder block and wherein ends of the pistons oriented away from the radial cylinder block are movably supported at an inner enveloping surface of the cam ring during a rotation of the radial cylinder block;

two control plate elements including a total of at least two control cross-sections, at least one control cross-section connected with an inlet channel and at least another control cross-section connected with an outlet channel, wherein the two control plate elements extend respectively with a face oriented towards a central plane of the radial cylinder block, wherein the central plane is perpendicular to the rotation axis, and the two control plate elements extend with the faces oriented towards the radial cylinder block beyond a plane which is defined by a face of the radial cylinder block, wherein the face of the radial cylinder block is oriented towards the respective control plate element at a greatest axial width of the radial cylinder block;

a plurality of pass through channels in the radial cylinder block corresponding to the plurality of bores in the radial cylinder block, wherein the pass through channels as a function of a rotational position of the cylinder block in the cam ring respectively connect the operating cavity with the control cross-section corresponding with the inlet channel or with the control cross-section corresponding with the outlet channel or are closable by a closing surface arranged at the control plate element, wherein each control plate element includes a radial bearing portion in which radial forces from the radial cylinder block are transferrable to a respective opposite radial surface in the housing or to a radial surface of a housing cover supported in the housing through a direct contact of the radial bearing portion with the radial surface, wherein one control plate element of the two control plate elements is arranged respectively on both sides of the radial cylinder block, and wherein a first control plate element of the two control plate elements is preloaded through an undulated washer supported at the housing or at the housing cover in a direction towards a second opposite control plate element of the two control plate elements.

* * * * *